United States Patent [19]

Dawson

[11] Patent Number: 4,916,841

[45] Date of Patent: Apr. 17, 1990

[54] LUGGAGE TAG CODISPENSABLE WITH PASSAGE TICKETS AND CONVERTIBLE INTO A HANDLE ENCIRCLING TAG AND METHOD

[75] Inventor: Murray Dawson, Clarendon Hills, Ill.

[73] Assignee: Rand McNally & Company, Skokie, Ill.

[21] Appl. No.: 261,602

[22] Filed: Oct. 24, 1988

[51] Int. Cl.[4] ..... G09F 3/14

[52] U.S. Cl. ..... 40/665; 40/6

[58] Field of Search ..... 40/665, 662, 6; 283/80

[56] References Cited

U.S. PATENT DOCUMENTS 1,384,457 7/1921 Fetters ..... 40/6

3,228,129 1/1966 Gwinn et al. ..... 40/66 Z 4,042,171 8/1977 Ross et al. ..... 40/6

*Primary Examiner*—Gene Mancene

*Assistant Examiner*—Cary E. Stone

*Attorney, Agent, or Firm*—Dressler, Goldsmith, Shore, Sutker & Milnamow, Ltd.

[57] ABSTRACT

A disposable luggage identifying ticket convertible into a luggage handle encircling baggage tag. The ticket comprises a pair of elongated generally coextensive sheets of stock secured to each other, each sheet having a pair of parallel sides and a pair of parallel ends, and configured to be separable into a main portion and a loop forming strap, once removed, being adhesively securable to the main portion. A method of forming a baggage tag from the ticket, and the baggage tag so formed are also described.

14 Claims, 1 Drawing Sheet

10
10A
10A'
20
21
22
23
24
25
26
27
28
29
40
40A
40A'
41
42
43
44
45

LUGGAGE TAG CODISPENSABLE WITH PASSAGE TICKETS AND CONVERTIBLE INTO A HANDLE ENCIRCLING TAG AND METHOD

BACKGROUND OF THE INVENTION

This invention relates to disposable identifying tickets for temporary attachment to pieces of baggage.

Disposable baggage tags have become virtually indispensable in a world of constantly expanding travel and commerce. Such baggage tags provide essential identification of destination and customer at airports, railroad stations, freight handling terminals, and the like, and countless numbers of them are used daily. Owing to their widespread use and temporary character, the cost of such baggage tags as well as their ease of issuance, become significant factors in their acceptability. Other important considerations are their ease of attachment and resistance to tearing and inadvertent removal during the coarse handling to which the tagged articles are frequently subjected.

In general, baggage tags comprise an elongated, relatively narrow rectangular strip of flexible material made of a paper product or an equivalent synthetic substitute. The tag usually includes a claim check portion to be removed and given to the customer and means for attaching the tag to the article to be identified.

One form of prior art baggage tag comprises a strip made of a relatively heavy card stock paper. The card stock paper strip is provided with an eyelet at one end and a string or elastic loop is connected through the eyelet permitting attachment to the baggage handle with a form of loop or hitch connection.

In other forms of prior art baggage tags, a strip comprises a laminate of paper and polyester film construction or a sheet of spun polyester filaments of the type commonly used in well-known non-tear envelopes. In each of those prior art constructions, the inner face of the strip is usually partially or completely coated with an adhesive or cohesive glue. In order to attach those tags, the strip is passed through the baggage handle and the two ends adhered together, usually after removal of a protective liner, to form a closed loop.

Still another form of prior art identification tag comprises a strip of substantially ordinary paper having a longitudinal slit adjacent one end thereof. The paper strip is attached to the article handle by simply passing one end thereof through the slit to form a rather loosely connected loop. That tag is most suitable for safe applications, such a customer hand-carried luggage or coat check rooms, because it is not adapted to withstand the rough treatment encountered when the baggage is handled by a carrier or others. A tag of that type is illustrated in U.S. Pat. No. 3,231,992.

Efforts to provide improved luggage identifying tickets, and those which may be codispensable with passage tickets have been attempted, as illustrated by U.S. Pat. No. 4,631,845. In that patent a special configuration is disclosed.

It would be desirable to provide an improved luggage ticket which may be codispensable with a passage ticket and which is easy to use and to attach to luggage.

SUMMARY OF THE INVENTION

In accordance with the present invention an improved luggage identifying ticket which may be converted into a baggage tag and claim check is provided along with a tag and a method of making the tag. The convertible ticket comprises a pair of elongated generally coextensive sheets of stock, such as paper stock, secured to each other, each of the sheets having a pair of parallel sides and a pair of parallel ends, and configured to be separable into a main portion and a loop forming strap adhesively securable to the main portion. The sheets are adhesively secured in an overlying confronting relationship along one of their respective confronting sides.

One of the sheets provides a line of severance between the sides, and generally parallel to the sides, dividing that sheet into a strap zone on one side of the line of severance. The strap zone is separable from that sheet, and, when separated, is adapted to be formed into a loop. The other side or second zone of that sheet is adhesively secured to the other sheet.

In a preferred form the strap zone includes adhesive, such as pressure sensitive adhesive, at each end, so that each end may be secured to the main portion in a loop configuration, and the portion of the other sheet confronting the strap zone is foldable along the line of severance to overlie and to be adhesively secured over the second zone to form a main portion of reduced width, which desirably may be of a width which is substantially equal to the strap zone width.

The ticket desirably defines a portion configured to be separable into a claim check, and, in a preferred form, severance lines in one of the sheets are provided to define a claim check for removal from the ticket. The other sheet may define the severance lines in a portion confronting the strap zone. Releasable adhesive means securing the claim check and the strap zone are provided so that when the strap zone is removed along the line of severance to provide the strap, the claim check is removable therewith, and is removable therefrom as well.

When the strap is separated from a first side zone of a first of the pair of sheets, the first side of the second sheet is folded over and is adhesively secured to the second side to form the main body portion.

The elongated strap is then adhesively secured at each end to the main body portion, whereby the looped strap encircles a luggage handle, and the main body portion projects from said loop.

Further objects, features and advantages of the present invention will become apparent from the following description and drawings.

DESCRIPTION OF THE PRESENTLY PREFERRED EMBODIMENT

Figures 1, 2, 3, 4, 5, 6, 7, 8, 9:
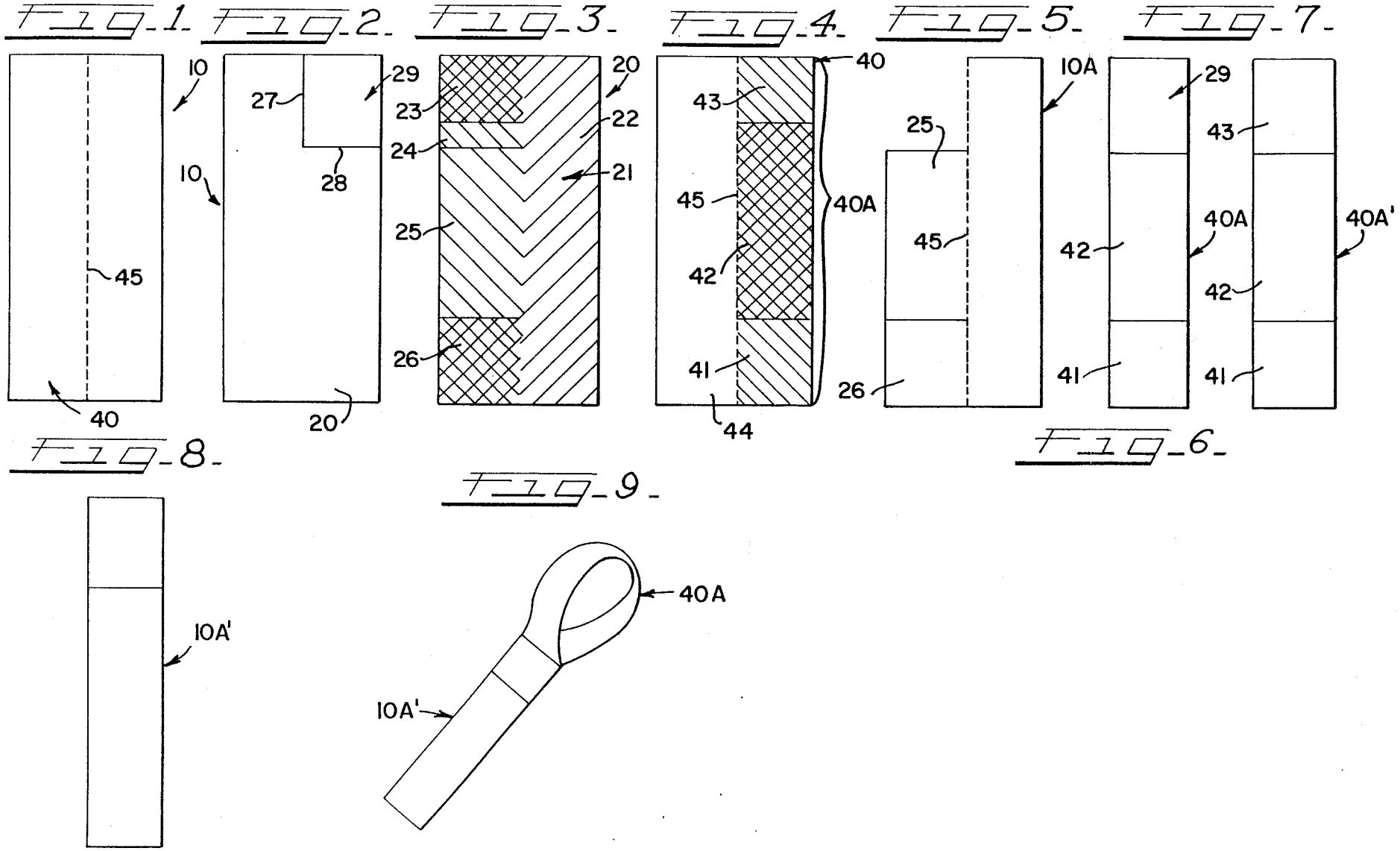
FIG. 1 is a front view of a luggage ticket of the present invention.
FIG. 2 is a back view of the ticket of FIG. 1.
FIG. 3 is a front view of the back sheet of the ticket of FIG. 1.
FIG. 4 is a back view of the front sheet of the ticket of FIG. 1.
FIG. 5 is a front view like FIG. 1, but with strap and claim check portions of the ticket removed.
FIG. 6 is a rear view of the strap and claim check portions of the ticket as removed from the remaining portion as shown by FIG. 5.
FIG. 7 is a view like that of FIG. 6, but with the claim check removed.
FIG. 8 is a view of the ticket of FIG. 5 with the left portion (as viewed in FIG. 5) folded over the right portion.
FIG. 9 shows the ticket portions of FIGS. 7 and 8 assembled to encircle a baggage handle.

Referring now to the drawings, a luggage ticket 10 which may be codispensable with passage tickets, may be of a size the same as passage tickets such as, typically about 3¼ inches × 8 inches. The total caliper or thickness of the ticket 10, including all of its components, should approximate the caliper of the codispensed passage ticket which, typically, may be about 0.007 inch. Ticket 10 comprises a pair of elongated, generally coextensive confronting sheets, normally a first back sheet 20 (FIG. 3) and a second front sheet 40 (FIG. 4), each of which may be a paper sheet. As may be seen, each sheet comprises a pair of parallel sides and a pair of parallel ends.

Back sheet 20, as seen in FIG. 3, comprises a sheet of suitable weight and character. Thus back sheet 20 may be a suitable paper material as shown or a synthetic material with suitable characteristics to be utilized as a baggage tag. The material may be a laminated stock, and preferably should exhibit a tear strength of at least about 15 pounds per inch. Its front face 21, which confronts the back side of the front sheet, is provided with a series of zones of adhesive material and release material for purposes to be explained. Thus zone 22 comprises an adhesive, such as a hot melt adhesive for permanent adherance to the confronting back surface of the front sheet 40. The other side of the rear of sheet 20 comprises a series of zones, including a zone 23 of a release material such as a conventional silicone release material, a zone 24 of adhesive material, such as a pressure sensitive adhesive, a further zone 25 of adhesive, such as a conventional pressure sensitive adhesive, and a further release zone 26, as of silicone.

The front sheet 40 is of the same dimensions as back sheet 20, and may comprise material the same as, or different from, the material of which sheet 20 is formed. Desirably front sheet 40 is a paper material as shown or a synthetic stock material which may or may not be thermally coated to meet the imprinting requirements of the dispensing machine. The rear face of the front sheet 40 is shown in FIG. 4, and has an adhesive zone 41 which is generally complementary in size and location to release zone 26, and a release zone 42, as of silicone, generally complementary in size and configuration to pressure sensitive zones 24 and 25. The rear of sheet 40 also defines a pressure sensitive adhesive zone 43 which is generally complementary in size and configuration to release zone 23. Thus, when the rear of sheet 40 and face of sheet 20 are overlaid and are in close contact, the release zones of one confront the pressure sensitive zones of the other for appropriate securance and subsequent separation.

The vertical zone 44 of sheet 40 and the adhesive zone 22 of sheet 20 are in contact and permanently secure those zones to each other. Thus, the sheets 20, 40 are adhesively secured in their overlying confronting relationship along one of their respective confronting sides. Of course the adhesive zone 22 may be blank and a like zone applied to sheet 40 instead in zone 44.

As appears in the drawings, front sheet 40 defines a vertical line of severance 45, such as via a line of perforations, by which vertical strap zone 44 may be severed from zones 41–43, thereby to provide a strap 40A. The line of severance thus divides sheet 40 along a line which is generally parallel to its sides, and preferably divides the sheet into zones of generally equal width on opposite sides of the line.

Additionally, the back sheet 20 is provided with vertical and horizontal lines of separation or severance, such as butt cuts 27 and 28, which are preferably provided after assembly of the sheets 20, 40. Desirably, as shown, the lines of severance 27, 28 are in the portion of sheet 20 which confronts the strap 40A. Thus, the butt cuts 27 and 28 thereby define a claim check portion 29 in the ticket which is complementary in size and configuration to the combined release zone 23 and adhesive zone 24, on the one hand, but which includes and comprises the adhesive zone 43 and part of the silicone zone 42, on the other hand.

As may be seen from FIGS. 5 and 6, when the strap zone or strap 40A is severed from the assembled front and rear sheets 40, 20 along line of severance 45, the strap initially carries with it the claim check 29 (see FIG. 5), and leaves behind a main body or baggage ticket portion 10A. When the left side of portion 10A as shown in FIG. 5 is folded over along the zone of the severed line of severance 45, zone 25 of the back sheet is adhered to the right side (of FIG. 1) of the front sheet, thereby to produce a baggage tag portion 10A' as seen in FIG. 8. Desirably the folded over portion 10A' is of a reduced width which is substantially equal to the width of the strap 40A'.

The removed strap zone or strap 40A' includes adhesive at each end so that it may be secured to the main body portion in a loop configuration. When viewed from the back, the strap 40A' is temporarily adhesively secured with the claim check 29, as seen in FIG. 6. When the claim check 29 is removed, the strap 40A' appears (FIG. 7), also from the rear, just as it did in FIG. 4. The claim check 29 may be secured, as to a passenger's ticket wallet, via adhesive zone 24 after its removal from the strap 40A'.

After removal of the claim check 29, the strap 40A' and main body portion 10A' are adapted to be adhesively secured to form a loop which is adapted to encircle a baggage handle. To that end, the pressure sensitive adhesive zones 41, 43 are adapted to be secured, each adjacent an end of the folded main body portion 10A' (FIG. 8), one on each side thereby to produce the baggage tag illustrated in FIG. 9.

It will be apparent to those skilled in the art that modifications may be made in the embodiment illustrated herein without departing from the spirit and scope of the present invention. Accordingly, the invention is not to be considered as being limited, except insofar as may be necessitated by the claims.

What is claimed is:

1. A disposable luggage identifying ticket convertible into a luggage handle encircling baggage tag, said ticket comprising a pair of elongated generally coextensive sheets of stock secured to each other, each said sheet having a pair of parallel sides and a pair of parallel ends, and configured to be separable into a main portion and a loop forming strap adhesively securable to said main portion, said sheets being adhesively secured in an overlying confronting relationship along one of their respective confronting sides, and a line of severance dividing one of said sheets along a line between, and generally parallel to, its sides into a strap zone on one side of the line of severance and being separable from said one sheet, said strap zone when separated being adapted to be formed into a loop, and a second zone on the other side of the line of severance, said other side being adhesively secured to the other sheet.

2. A disposable ticket in accordance with claim 1, and wherein said strap zone includes adhesive at each end, so that each end may be secured to said main portion in a loop configuration.

3. A disposable ticket in accordance with claim 1, and wherein the portion of said other sheet confronting said strap zone is foldable along said line of severance to overlie and to be adhesively secured over said second zone to form a main portion of reduced width.

4. A disposable ticket in accordance with claim 3, and wherein the main portion of reduced width is of a width substantially equal to the strap zone width.

5. A disposable ticket in accordance with claim 1, and wherein said ticket defines a portion configured to be separable into a claim check, and severance lines in one of said sheets to define said claim check for removal from said ticket.

6. A disposable ticket in accordance with claim 5, and wherein said other sheet defines said severance lines in a portion confronting said strap zone, and releasable adhesive means securing said claim check and said strap zone, whereby when said strap zone is removed along said line of severance to provide a strap, said claim check is removable therewith and is removable therefrom.

7. A baggage tag having a loop forming strap encircling a luggage handle, said tag comprising an elongated looped strap and a main body portion, both formed from a pair of elongated sheets of paper stock, said strap being separated from a first side of a first of said pair of sheets, the second side of said first sheet being adhesively secured to an underlying generally coextensive second side of the second of said sheets, the first side of said second sheet being folded over and adhesively secured to said second sides to form said main body portion, and means adhesively securing each end of said elongated strap to said main body portion, whereby said strap is looped to encircle a luggage handle and said main body portion projects from said loop.

8. A baggage tag in accordance with claim 7, and wherein said means, adhesively securing the strap ends comprises pressure sensitive adhesive at each end of said strap.

9. A baggage tag in accordance with claim 7, and wherein said strap and said main body portion are of substantially the same width.

10. A method of providing a luggage handle encircling baggage tag, said tag being formed from a pair of elongated, generally coextensive, confronting sheets of stock secured to each other, each said sheet having a pair of parallel sides and a pair of parallel ends, and configured to be separable into a main portion and a loop forming strap adhesively secured to said main portion, the steps comprising adhesively securing said sheets in an overlying confronting relationship along one of their respective confronting sides, providing a line of severance dividing one of said sheets along a line between, and generally parallel to, its sides into a strap on one side of the line of severance and a second zone adhesively secured to the other sheet on the other side of the line of severance, separating said strap along said line of severance from said one sheet, folding the other sheet along the line of severance so that a folded portion of the second sheet overlies and adheres to the second zone to form a main body, and adhesively securing the ends of said strap to one end of the main body to form a loop.

11. The method in accordance with claim 10, and wherein said strap includes adhesive at each end, so that after severance of said strap along said line of severance, each end of said strap is secured to said main portion to form, said loop.

12. The method in accordance with claim 10, and wherein the main body is folded to a width substantially equal to the width of the strap.

13. The method in accordance with claim 10, and comprising the further step of providing lines of separation in said other sheet to define a claim check which is removable from said other sheet.

14. The method in accordance with claim 13, and wherein the lines of separation are in said other sheet in a location confronting said strap, and said claim check is adhesively removably secured to said strap so that when said strap is separated along said line of severance, said claim check is separated therewith for subsequent removal therefrom.

* * * * *